US010647458B2

(12) United States Patent
Bourgeois et al.

(10) Patent No.: US 10,647,458 B2
(45) Date of Patent: May 12, 2020

(54) OPTICAL DEVICE FOR CHECKING A FACE OF A BLANK

(71) Applicant: BOBST MEX SA, Mex (CH)

(72) Inventors: Sacha Bourgeois, Bussigny (CH); Dimitri Favini, Villars-Bozon (CH)

(73) Assignee: BOBST MEX SA (CH)

( * ) Notice: Subject to any disclaimer, the term of this patent is extended or adjusted under 35 U.S.C. 154(b) by 295 days.

(21) Appl. No.: 15/527,205

(22) PCT Filed: Nov. 10, 2015

(86) PCT No.: PCT/EP2015/025078
§ 371 (c)(1),
(2) Date: Jun. 23, 2017

(87) PCT Pub. No.: WO2016/078776
PCT Pub. Date: May 26, 2016

(65) Prior Publication Data
US 2017/0320607 A1 Nov. 9, 2017

(30) Foreign Application Priority Data
Nov. 19, 2014 (EP) ..... 14020088

(51) Int. Cl.
*B65B 43/12* (2006.01)
*B65B 43/14* (2006.01)
(Continued)

(52) U.S. Cl.
CPC ..... *B65B 43/126* (2013.01); *B31B 50/006* (2017.08); *B31B 50/07* (2017.08);
(Continued)

(58) Field of Classification Search
CPC ..... B65B 43/126; B65H 5/226; B65H 5/224; B31B 50/006
See application file for complete search history.

(56) References Cited

U.S. PATENT DOCUMENTS 8,348,817 B2 * 1/2013 Bruns ..... B31B 50/00 493/11
2004/0164482 A1 8/2004 Edinger ..... 271/197
(Continued)

FOREIGN PATENT DOCUMENTS

DE 44 42 629 A1 6/1996
DE 100 08 831 A1 9/2001
(Continued)

OTHER PUBLICATIONS

International Search Report dated Jan. 29, 2016 in corresponding PCT International Application No. PCT/EP2015/025078.
(Continued)

*Primary Examiner* — Gene O Crawford
*Assistant Examiner* — Lester III Rushin
(74) *Attorney, Agent, or Firm* — Ostrolenk Faber LLP

(57) ABSTRACT

A device (10) for optically controlling a face (13) of a blank (12) has a vacuum conveyor (20) capable of transporting the blank (12) along a path of travel (15) and which includes a conveyor belt (22) having an apertured structure of which the conveying path follows the path of travel (15) of the blank (12). A suction device (40) is suitable for pressing the blank (12) against the conveyor belt (14). An inspection device (30) inspects the face (13) of the blank (12) during its conveyance by the vacuum conveyor (20). The inspection device is located on the side opposite the vacuum conveyor (20). The suction device (40) delimits three separate successive suction sections (41, 42, 43) along the path of travel (15), including a central suction section (42) that extends opposite the inspection device (30), an upstream suction section (41) and a downstream suction section (43).

13 Claims, 2 Drawing Sheets

(51) Int. Cl.

| | |
|---|---|
| ***B31B 50/00*** | (2017.01) |
| ***B65H 7/14*** | (2006.01) |
| ***B31B 50/07*** | (2017.01) |
| ***B65H 5/22*** | (2006.01) |
| ***B31B 50/74*** | (2017.01) |
| ***B65H 7/06*** | (2006.01) |
| *B31B 120/30* | (2017.01) |
| *B31B 50/64* | (2017.01) |
| *B31B 50/04* | (2017.01) |
| *B31B 50/62* | (2017.01) |
| *B31B 50/26* | (2017.01) |
| *B31B 50/25* | (2017.01) |

(52) U.S. Cl.

CPC ..... *B31B 50/74* (2017.08); *B65B 43/145* (2013.01); *B65H 5/224* (2013.01); *B65H 5/226* (2013.01); *B65H 7/06* (2013.01); *B65H 7/14* (2013.01); *B31B 50/042* (2017.08); *B31B 50/25* (2017.08); *B31B 50/26* (2017.08); *B31B 50/624* (2017.08); *B31B 50/64* (2017.08); *B31B 2120/302* (2017.08); *B65H 2220/01* (2013.01); *B65H 2220/03* (2013.01); *B65H 2301/44734* (2013.01); *B65H 2404/255* (2013.01); *B65H 2406/323* (2013.01); *B65H 2406/363* (2013.01); *B65H 2511/413* (2013.01); *B65H 2511/52* (2013.01); *B65H 2553/42* (2013.01); *B65H 2701/111* (2013.01); *B65H 2701/1764* (2013.01)

(56) References Cited

U.S. PATENT DOCUMENTS

| | | | | |
|---|---|---|---|---|
| 2009/0121417 | A1 | 5/2009 | Nishimura et al. ..... | 271/225 |
| 2011/0013170 | A1* | 1/2011 | Meyer ..... | B65H 5/224 355/72 |

FOREIGN PATENT DOCUMENTS

| | | | |
|---|---|---|---|
| DE | 10 2009 032 966 | A1 | 1/2011 |
| EP | 2 578 521 | A1 | 4/2013 |

OTHER PUBLICATIONS

Written Opinion dated Jan. 29, 2016 in corresponding PCT International Application No. PCT/EP2015/025078.

* cited by examiner

OPTICAL DEVICE FOR CHECKING A FACE OF A BLANK

CROSS-REFERENCE TO RELATED APPLICATIONS

The present application is a 35 U.S.C. §§ 371 national phase conversion of PCT/EP2015/025078, filed Nov. 10, 2015, which claims priority of European Patent Application No. 14020088.2, filed Nov. 19, 2014, the contents of which are incorporated by reference herein. The PCT International Application was published in the French language.

TECHNICAL FIELD

This invention concerns the area of manufacturing packaging, and in particular, packaging made from pre-cut sheets or blanks, in particular paper, plastic or cardboard blanks, whether flat, corrugated or mixed. Not exclusively, this invention is used in the area of manufacturing folding boxes.

More specifically, this invention concerns a device enabling the quality of blanks circulating in a processing machine such as a folder-gluer machine.

TECHNICAL BACKGROUND

In the packaging industry, manufacturing folding boxes is carried out traditionally on lines, by folding and gluing blanks by means of machines, commonly called folder-gluer machines. In this regard, it is known to inspect the quality of blanks within the same folder-gluer. For this, a specific module is used and is directly integrated into the folder-gluer. This module is able to individually inspect each blank when it passes through the module. As the moving of blanks is done on the printed face turned towards the back within the folder-gluer, their transportation through the inspection module is carried out by holding them by the top, while they are inspected on the bottom.

In practice, transporting the blanks by their tops is done by using a vacuum conveyor unit, which connects multiple conveying belts to a vacuum box positioned directly above. Each blank is thus held by the top of its internal face, so that its printed face, which is turned towards the bottom, is entirely clear. Inspecting its bottom is carried out by a camera, which is set up under the vacuum conveyor unit, and which functions at a low angle. The camera is connected to a suitable lighting system. The camera takes a photo of each printed face, progressively as the blanks scroll through.

STATE OF THE ART

Document EP 2578521 describes machines of the prior art carrying out such an inspection. In this case, the traffic path of the blank passes into a section with a background element which improves the inspection of the edge and which is located between two separate sections, slightly spaced out from the traffic path. Each section is equipped with a box, wherein a vacuum is generated to hold the blank flattened by its upper face against a conveying belt, while its lower printed face is inspected. In this way, not only are faults present inside the blank, but also faults are present on the edge of the blank, which are able to be detected. The faults are defined for example, particularly, as respectively from printing errors in the text, colors, the color register, etc., embossing errors, and other faults in appearance, such as holes, breaks, tears, etc., errors in cutting, oil marks, etc.

However, this known technique brings instability to the position of the blank, because in the area of the background element, which is certainly a lot smaller than the length of the blank, the blank is not held by suction. During the progression of the blank from the upstream section of the vacuum conveyor unit towards the downstream section of the vacuum conveyor unit, the blank is cantilevered when its front edge and then its trailing edge is no longer being sucked.

SUMMARY OF THE INVENTION

An object of this invention is to propose an improved inspection device, which ensures a stable position of the blank when it is passed in front of inspection and surface control means.

According to the invention, this object is achieved, in particular by means of a device, optically inspecting a face of a blank, comprising:

a vacuum conveyor unit, which transports the blank along a traffic path, and the vacuum conveyor unit comprising a conveying belt, having a perforated structure, advances on a journey that follows the traffic path of the blank, and suction means, which are able to flatten the blank against the conveying belt, and an inspection device to inspect the face of the blank during its transport by the vacuum conveyor unit, wherein the inspection device is located on the side of the blank opposite to the side facing vacuum conveyor unit.

The optical inspection device includes a suction device that define three separate successive suction sections along the traffic path. These include a central suction section which extends facing the inspection device, an entrance suction section and an exit suction section with the central suction section between them.

Such a device enables the vacuum to be adjusted, for enabling the blank to be sucked and held against the conveying belt on the central suction section, and therefore on the inspection device. Thus, the most suitable vacuum intensity can be chosen to stabilize the blank, in view of it being inspected by the inspection means.

Suction may be applied along the entire traffic path prior to, at and after the central section. Suction is preferably higher at the central section where the blank should be securely held to not shift on the conveying belt. The vacuum will be higher at the central section where it is needed. In addition, the blank is held by suction securely against guide rollers at the central section. There is a short length opening at the central section at the rollers so that the entrance for suctioned air is narrowed for providing better holding of the blank on the conveying belt while the blank is inspected.

According to a beneficial arrangement, the inspection device additionally includes means opposite the inspection means for tensioning the conveying belt. In this way, the holding and the rigidity of the belt are improved with reference to the inspection means, which prevents movements and/or changes in orientation of the blank, when the blank passes in front of the inspection means. In particular, these tensioning means can be disposed to guarantee flatness of the conveying belt, so that the position of the blank on the belt enables optimal optical inspection, using controlled and constant orientation of the blank in relation, on the one hand, to the lighting system and, on the other hand, to the camera.

Moreover, the invention can be implemented, regardless of the direction of movement of the blanks, by consequently adapting the arrangement of the conveying belt, the inspection device and the suction device, along the blank traffic path.

Thus, such an inspection device can be achieved during the movement of each blank, which is carried out with the printed face preferably turned towards the bottom, for example, by holding the blank by its top, while the inspection of the printed face is carried out at the bottom.

According to another embodiment, the inspection device is disposed in a way that each blank is moved via the conveying belt with its printed face oriented towards the top, so that the inspection is carried out from the top and, for example, the blank is held by the bottom.

The inspection device is also possible in the event where the movement of blanks is carried out in a substantially vertical plane.

This invention also relates to a processing machine, and in particular, a folder-gluer machine, equipped with a corrective device as disclosed herein.

BRIEF DESCRIPTION OF THE DRAWINGS

Examples of implementing the invention are indicated in the description illustrated by the appended figures, wherein.

DESCRIPTION OF AN EMBODIMENT

Figure 1:
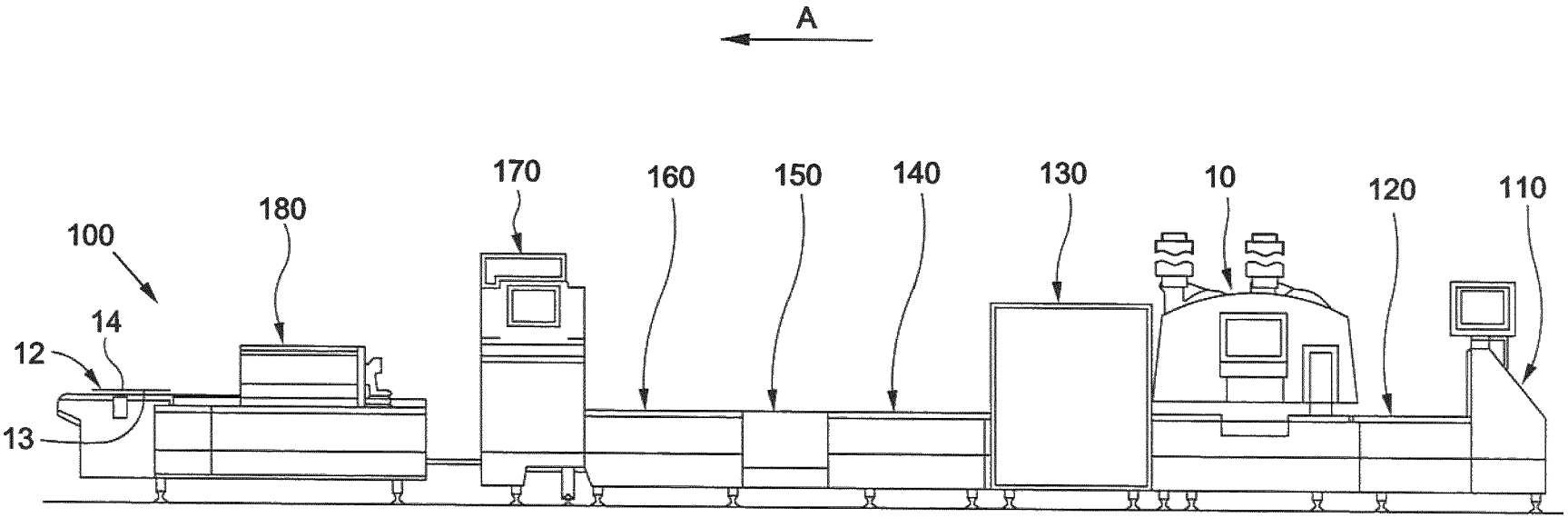
FIG. 1 schematically represents a folder-gluer, in which there is an inspection device according to the invention.

FIG. 1 shows a folder-gluer machine 100, which folds and glues blanks for manufacture of folding boxes. This folder-gluer 100 is equipped with a modular structure including, from entrance to exit, a feeder module 110 or feeder table, an alignment module 120, an embossing module 130, particularly useful for Braille, a fold pre-breaking module 140, a gluing module 150, a folding module 160, a transfer module 170 and a receiving module 180. The blanks are moved from one module to the next in the folder-gluer machine 100, in the longitudinal direction (Arrow A, FIGS. 1 and 2).

The folder-gluer 100 is additionally equipped with an inspection device 10, which is directly integrated between the alignment module 120 and the embossing module 130. This inspection device 10 is configured to carry out an on-line quality inspection within the folder-gluer 100, by systematically inspecting all blanks 12 which circulate, with their printed face 13 turned towards the bottom (lower face), and their internal face 14, which is not printed, oriented towards the top (upper face).

Figure 2:
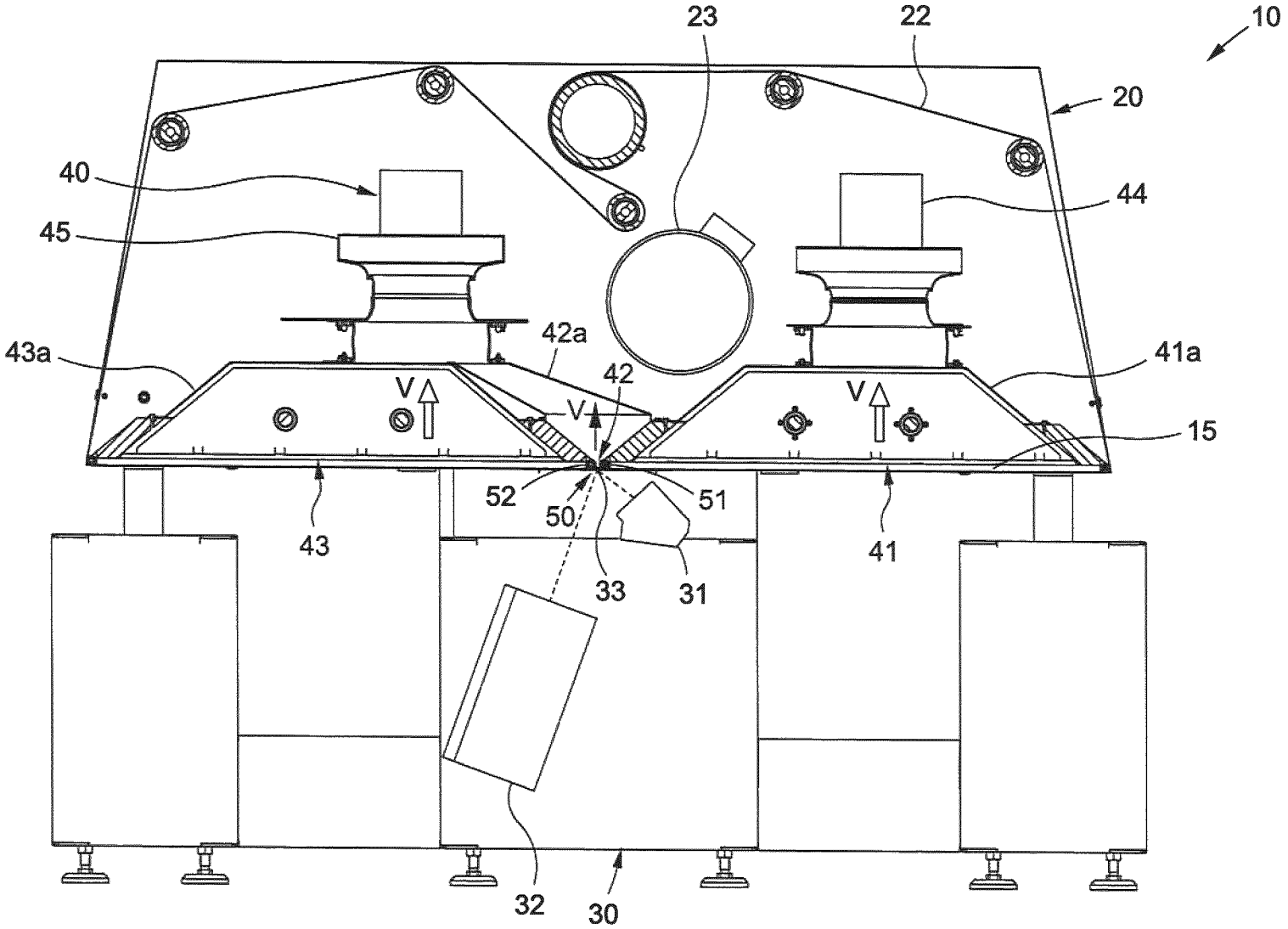
FIG. 2 is a longitudinal cross-sectional view of the inspection device according to the invention.

The inspection device 10 in FIG. 2 comprises a vacuum conveyor unit 20. The conveyor unit 20 comprises a conveying belt 22 or belt, which defines a closed loop which continuously transports each blank 12. Each blank 12 is transported by being held at the top on its upper face 14, which is intended to eventually constitute the internal face of a completed box, along a given traffic path 15. The conveying belt 22 is activated by the motor 23 in the form of an endless loop.

The lower face 13 of the blank 12 to be inspected is usually provided with symbols, which are with reliefs, hollow and/or bumps, and/or printed with text, images, etc., and generally any types of symbols.

The inspection device 10 also comprises inspection means 30 configured for inspecting the lower face 13 of each blank on the bottom, during transportation of the blank along the traffic path 15, which crosses the inspection device 10 from one end of the inspection device 10 to the other end of the inspection device 10, that is from the right to the left in FIG. 2. The inspection device 30 comprises a camera 32 and a lighting system 31, which are oriented to merge (see broken line in FIG. 2) toward the same inspection area 33. The inspection area 33, for example, is in the form of a transverse line or a transversally-extended rectangle located on the traffic path 15.

Thus, during its travel through the inspection device 10, the blank is held by the conveying belt 22 along the traffic path 15, where the path follows the substantially horizontal and flat lower section of the conveying belt 22. More specifically, the blank 12 is held by suction against the lower face of the conveying belt 22, by a suction device 40 positioned above the conveying belt 22 along the traffic path 15 of the blank 12.

According to the invention, the conveying belt 22 operates in three separate sections 41, 42 and 43 of the traffic path 15, which sections are successively crossed by the blank 12. These include an entrance suction section 41, followed by a central suction section 42, which extends opposite the inspection device 30, and which is followed by an exit suction section 43. In this way, during the inspection, the blank 12 is located flattened against the conveying belt 22 as the blank passes between the inspection device 30 and the conveying belt 22.

Each of the sections, the central suction section 42, the entrance suction section 41 and the exit suction section 43, comprises a respective box, in which a vacuum is generated, causing a pressure drop in the direction of arrows V in FIG. 2. More specifically, an entrance box 41*a*, a central box 42*a* and an exit box 43*a*, are aligned according to the direction of transportation A. The boxes 41*a*, 42*a* and 43*a* are all located above and behind the conveying belt 22, and that strip itself is located above and behind the blank 12, which itself is located above and behind the inspection means 30, during the visual inspection of the lower face 13 of the blank printed and/or provided with relief portions.

The conveying belt 22 is held flat continuously over its entire lower surface, extending along the traffic path 15 of the separate sections 41, 42 and 43 and the boxes 41*a*, 42*a* and 43*a*. The central suction box 42*a* comprises at least one suction opening at its bottom, and the opening(s) leads directly to the inspection area 33.

According to a non-represented embodiment, each box 41*a*, 42*a* and 43*a* can communicate with a vacuum pump. This solution with an individual suction pump for the entrance box 41*a*, the central box 42*a* and the exit box 43*a* is not always possible, in particular for volume reasons. In addition, the presence of three vacuum pumps presents a significant cost.

The vacuum conveyor unit 20 comprises a first vacuum pump 44 and a second vacuum pump 45. The first vacuum pump 44 is coupled to and communicates with the entrance suction box 41*a* of the entrance suction section 41. The second vacuum pump 45 is coupled to and communicates with both the central box 42*a* of the central suction section 42, and the exit box 43*a* of the bottom suction section 43. Coming out of the second vacuum pump 45, vacuum and resultant suction is shared between the central box 42, which holds a belt section 22, facing the inspection means 30, and the bottom box 43 which holds the belt section 22 located above the inspection means 30.

This sharing of suction supplied by the second vacuum pump 45 can take place according to a distribution chosen according to the data and size of the inspection device 10, and in particular, the volume of the central box 42*a* and of the bottom box 43*a*. For example, less than half of the outlet section of the second vacuum pump 45 is coupled with the central box 42*a* of the central suction section 42. According to another possible arrangement, less than one third less of the outlet section of the second vacuum pump 45 is coupled with the central box 42*a* of the central suction section 42. According to a preferred arrangement represented in FIG. 2, about one third of the outlet section of the second vacuum pump 45 is coupled with the central box 42*a* of the central suction section 42. In this case, the central box 42*a* and the bottom box 43*a* respectively represent between 5% and 95% of the total volume formed by the central box 42*a* and the exit box 43*a*.

According to a beneficial arrangement, at least one of the entrance box 41*a*, the central box 42*a* and the exit box 43*a* provides an adjustable suction volume. According to a preferred arrangement, as represented in FIG. 2, the entrance box 41*a* and the exit box 43*a* present a volume that can be modified. Such modularity is achieved, for example, by dividing the entrance box 41*a* and the exit box 43*a*, with internal walls and fitting the entrance box 41*a* and the exit box 43*a* with a mobile shutter at the air entrance of each box, which can be opened or closed as desired. As an alternative, as in FIG. 2, these are lateral panels of the entrance box 41*a* (exit box 43*a*), which extend in the direction of travel A, which are slidable in order to be able to widen or shrink the width of the entrance box 41*a* (exit box 43*a*). Such adjustment of the air entry into each box allows use of the amount of suction needed for holding the blank to the conveying belt along the traffic path.

The entrance box 41*a* and the exit box 43*a* each comprise a lower perforated wall, extending along the traffic path 15. The conveying belt 22 comprises a perforated structure, which is able to slide between each perforated wall. The belt 22 recovers, at least partially, the width of each perforated wall of the entrance box 41*a* and the exit box 43*a*. In a preferred arrangement, the belt 22 substantially completely recovers the width of each perforated wall of the entrance box 41*a* and the exit box 43*a*. The outlet section of the central box 42*a* is of a low amplitude, and is not equipped with a perforated wall.

The vacuum conveyor unit 20 comprises tensioning means 50 for the conveying belt 22, ensuring local rigidity of the belt 22 especially where the blank is being inspected. These tensioning means 50 comprise a pair of rollers 51 and 52, separated along the traffic path 15. More specifically, each upstream, entrance side roller 51 and each downstream, exit side roller 52 is positioned above the conveying belt 22. The suction generated by the vacuum in the central box 42*a* will flatten the belt 22 on and against these fixed rollers 51 and 52, which produces a flat inspection surface. The opening between rollers is short in length which increases the speed of the air drawn in between the rollers and holds the blank steady during inspection.

Thus, the rollers 51 and 52 are located along the central suction section 42. Moreover, preferably, the rollers 51 and 52 respectively define the entrance position and the exit position of the central suction section 43. The outlet of the central box 43*a* extends along the direction of transportation A between the rollers 51 and 52. For example, the rollers 51 and 52 are both spaced out along the direction of progression A at a distance of around 30 mm, and preferably between 20 mm and 50 mm.

This invention is not limited to the embodiments described and illustrated. Numerous modifications can be made, without moving away from the framework defined by the scope of the set of claims.

The invention claimed is:

1. An optical inspection device for inspecting a face of a blank advancing past the inspection device, the optical inspection device comprising:

a vacuum conveyor unit configured to transport the blank along a traffic path, the conveyor unit comprising a conveying belt having a perforated structure, a drive for moving the conveying belt, the moving conveying belt defining the traffic path of the blank, a suction device located and configured to flatten the blank against the conveying belt, and an inspection device located and configured for inspecting a first face of the blank during transportation of the blank by the vacuum conveyor unit, and the vacuum conveyor unit is located at an opposite second face of the blank from the inspection device;

the suction device is configured to define three successive separate suction sections along the traffic path, applying suction to the conveying belt for holding the blank to a strip;

the three further suction device sections comprising:

a central suction section which extends opposite the inspection device, an entrance side suction section and an exit side suction section along the traffic path, wherein the central suction section comprises a central suction box in which a vacuum is generated and comprising at least one suction opening that leads directly to a control area, wherein the central suction section is between the entrance side suction section and the exit side suction section.

2. A device according to claim 1, further comprising, a tensioning device configured for tensioning the conveying belt, and the tensioning device being located opposite the inspection device.

3. A device according to claim 2, wherein the tensioning device comprises a pair of rollers separated along the traffic path and together configured and operable for tensioning the strip then passing the rollers.

4. A device according to claim 3, wherein the rollers are located along the central suction section.

5. A device according to claim 4, wherein the rollers define the entrance and exit positions of the central suction section.

6. A device according to claim 1, wherein the central suction section, the entrance suction section and the exit suction section each respectively comprise a box, in which the suction device vacuum is generated.

7. A device according to claim 6, further comprising a vacuum pump communicating with each box.

8. A device according to claim 7, comprising:

a first vacuum pump which communicates with both of an entrance box of the entrance suction section and the central suction box of the central suction section; and a second vacuum pump which communicates with an exit box of the exit suction section.

9. A device according to claim 8, wherein less than half of an outlet section of the second vacuum pump is coupled with the central box of the central suction section.

10. A device according to claim 8, wherein at least one of the suction boxes is configured to provide an adjustable suction volume.

11. A device according to claim 7, wherein the entrance box and the exit box each comprise a perforated wall extending along the traffic path, and the conveying belt presents a perforated structure which is configured to slide against the perforated wall.

12. A processing machine equipped with an inspection device according to claim 1.

13. A folder-gluer machine equipped with an inspection device according to claim 1.

* * * * *